US007037153B1

(12) United States Patent
Wynne

(10) Patent No.: US 7,037,153 B1
(45) Date of Patent: May 2, 2006

(54) SURFBOARD SHARK REPELLENT SYSTEM

(76) Inventor: Brian M. Wynne, 1 Meadowbrook Dr., Huntington Station, NY (US) 11746-2916

( * ) Notice: Subject to any disclaimer, the term of this patent is extended or adjusted under 35 U.S.C. 154(b) by 0 days.

(21) Appl. No.: 11/172,160

(22) Filed: Jun. 29, 2005

(51) Int. Cl.
*B63B 35/79* (2006.01)

(52) U.S. Cl. ..... 441/74; 367/139

(58) Field of Classification Search ..... 441/74; 367/139; 119/220, 174
See application file for complete search history.

(56) References Cited

U.S. PATENT DOCUMENTS

| | | | | |
|---|---|---|---|---|
| 3,164,772 | A | 1/1965 | Hicks, IV | 325/118 |
| 3,317,889 | A * | 5/1967 | Barrand | 367/139 |
| 3,822,403 | A | 7/1974 | Coleman | 325/28 |
| 4,211,980 | A | 7/1980 | Stowell | 455/40 |
| 4,646,276 | A * | 2/1987 | Kowalewski et al. | 367/139 |
| 5,158,039 | A | 10/1992 | Clark | 119/29 |
| 5,566,643 | A | 10/1996 | Charter et al. | 119/220 |
| 5,570,322 | A * | 10/1996 | Miller | 367/107 |
| 6,606,963 | B1 | 8/2003 | Wynne | 119/220 |
| 6,837,182 | B1 * | 1/2005 | Leblanc | 119/220 |
| 2004/0008581 | A1 * | 1/2004 | Nadeau | 367/139 |
| 2005/0039692 | A1 * | 2/2005 | Wescombe-Down | 119/220 |

* cited by examiner

*Primary Examiner*—Ed Swinehart

(57) ABSTRACT

A surfboard shark repellent system for repelling sharks away from an individual while surfing. The surfboard shark repellent system includes an attachable magnet and a transmitter unit that emits sound waves at a frequency undesirable to sharks. The transmitter unit is contained in a watertight enclosure affixed to the upper surface towards the rear end of a surfboard usually submerged in the water while the user waits for a wave. The magnet attaches to the transmitter unit functioning as an on/off switch for the transmitter unit and is also connected to the user by a tether and band.

16 Claims, 8 Drawing Sheets

SURFBOARD SHARK REPELLENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to animal repellent devices and more specifically it relates to a surfboard shark repellent system for repelling sharks away from an individual while surfing.

2. Description of the Related Art

Any discussion of the prior art throughout the specification should in no way be considered as an admission that such prior art is widely known or forms part of common general knowledge in the field.

Underwater acoustic beacons have been in use for years. Typically, underwater acoustic beacons continually send out a repetitive signal at a preset frequency. These devices are often times referred to as "pingers" which are often times utilized to mark locations or objects underwater for later recovery or relocation.

Current shark deterrent devices use an electric field for repelling a shark. The electric field is operated near a shark's nervous system's normal frequency which over stimulates the nervous system of the shark. Unfortunately, electric fields have a relatively limited range about the body of the user.

While these devices may be suitable for the particular purpose to which they address, they are not as suitable for repelling sharks away from an individual while surfing. Conventional shark repellent systems have focused upon the usage of electric fields which have a limited range around a swimmer.

In these respects, the surfboard shark repellent system according to the present invention substantially departs from the conventional concepts and designs of the prior art, and in so doing provides an apparatus primarily developed for the purpose of repelling sharks away from an individual while surfing.

BRIEF SUMMARY OF THE INVENTION

In view of the foregoing disadvantages inherent in the known types of animal repellent devices now present in the prior art, the present invention provides a new surfboard shark repellent system construction wherein the same can be utilized for repelling sharks away from an individual while surfing.

The general purpose of the present invention, which will be described subsequently in greater detail, is to provide a new surfboard shark repellent system that has many of the advantages of the animal repellent devices mentioned heretofore and many novel features that result in a new surfboard shark repellent system which is not anticipated, rendered obvious, suggested, or even implied by any of the prior art animal repellent devices, either alone or in any combination thereof.

To attain this, the present invention generally comprises an attachable magnet and a transmitter unit that emits sound waves at a frequency undesirable to sharks. The transmitter unit is contained in a watertight enclosure affixed to the upper surface towards the rear end of a surfboard usually submerged in the water while the user waits for a wave. The magnet attaches to the transmitter unit functioning as an on/off switch for the transmitter unit and is also connected to the user by a tether and band.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a surfboard shark repellent system that will overcome the shortcomings of the prior art devices.

A second object is to provide a surfboard shark repellent system for repelling sharks away from an individual while surfing.

Another object is to provide a surfboard shark repellent system that is easily attached to a surfboard.

An additional object is to provide a surfboard shark repellent system that is durable.

A further object is to provide a surfboard shark repellent system that emits sound waves at a frequency that is aggravating and deterring to sharks.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
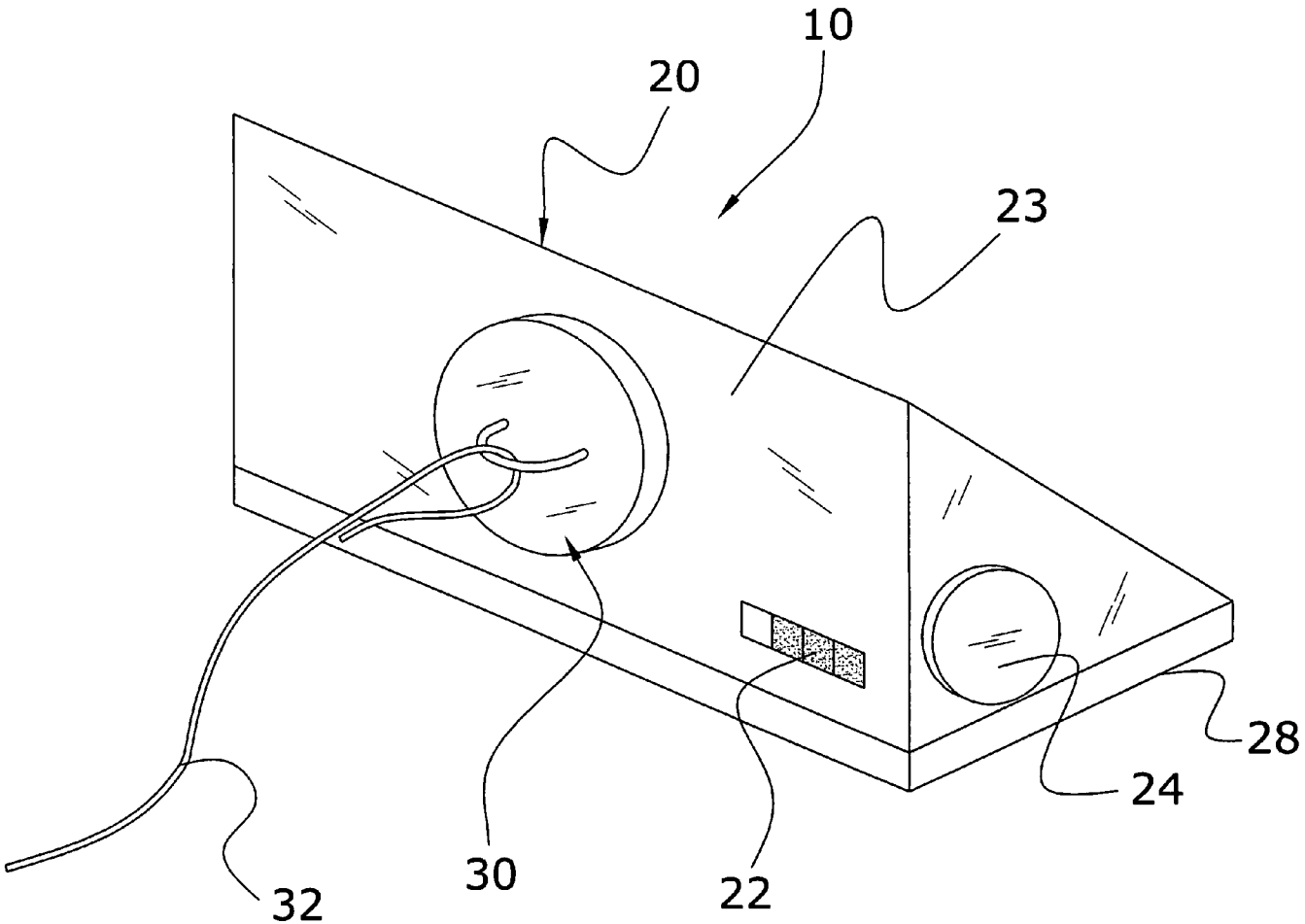
FIG. 1 is an upper perspective view of the present invention.

Turning now descriptively to the drawings, in which similar reference characters denote similar elements throughout the several views, FIGS. 1 through 8*b* illustrate a surfboard shark repellent system 10, which comprises an attachable magnet 30 and a transmitter unit 20 that emits sound waves 21 at a frequency undesirable to sharks 19. The transmitter unit 20 is contained in a watertight enclosure 23 affixed to the upper surface 15 towards the rear end 18 of a surfboard 14 usually submerged in the water while the user 12 waits for a wave. The magnet 30 attaches to the transmitter unit 20 functioning as an on/off switch for the transmitter unit 20 and is also connected to the user 12 by a tether 32 and band 34. The applicant hereby incorporates by reference U.S. Pat. No. 6,606,963 into this application.

B. Transmitter Unit

The transmitter unit 20 enclosure 23 is preferably comprised of a substantially rigid material which could withstand the weight of a user 12 stepping on it or being struck while loading and unloading into a vehicle. The transmitter unit 20 should be water tight with the enclosure 23 being impervious to liquids for preventing damage to the interior electronic components. The enclosure 23 is preferably made of a material which will withstand long exposure to salt water and humidity such that it will not rust or absorb water. The enclosure 23 is also preferably made of a material which will not degrade after long exposure to sunlight. The enclosure 23 is preferably molded plastic, however, is not limited from being metal or a composite material.

The transmitter unit 20 enclosure 23 is preferably constructed with a triangular cross section as illustrated in FIGS. 1, 2, 4 and 5 of the drawings, but it can be appreciated that the enclosure 23 could be constructed in various other shapes. The transmitter unit 20 enclosure 23 is preferably triangular in shape to provide a more fluidly aerodynamic structure and to allow the user 12 to utilize the angled side as a traction pad assisting in the steering of the surfboard 14. The transmitter unit 20 enclosure 23 is sized so the length dimension is substantially similar to the width of the rear end 18 of the surfboard 14, preferably approximately 5 inches.

Figure 8A:
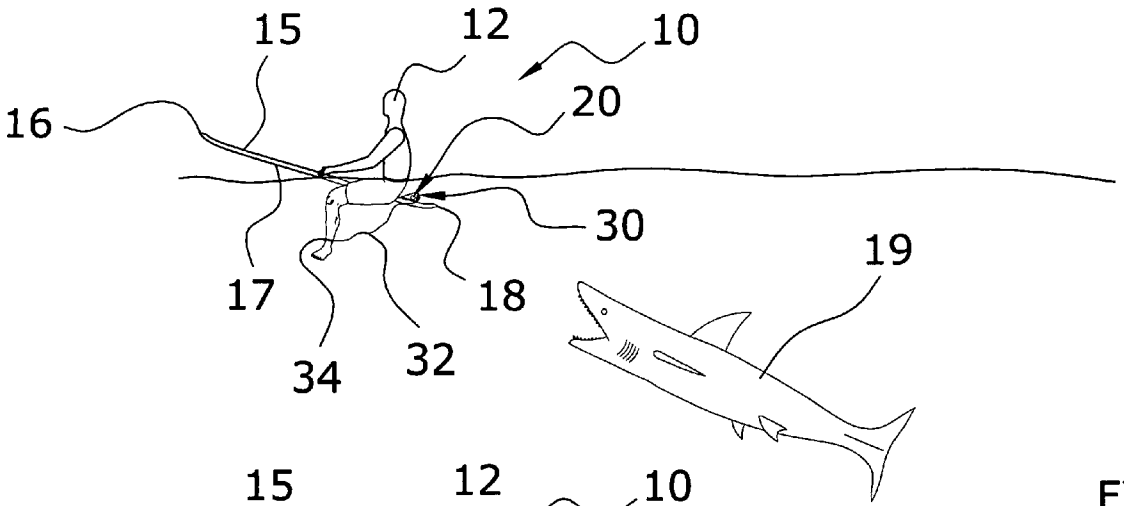
FIG. 8*a* is a side view of the present invention mounted on a surfboard and connected to a user by a tether as a shark approaches.
Figure 8B:
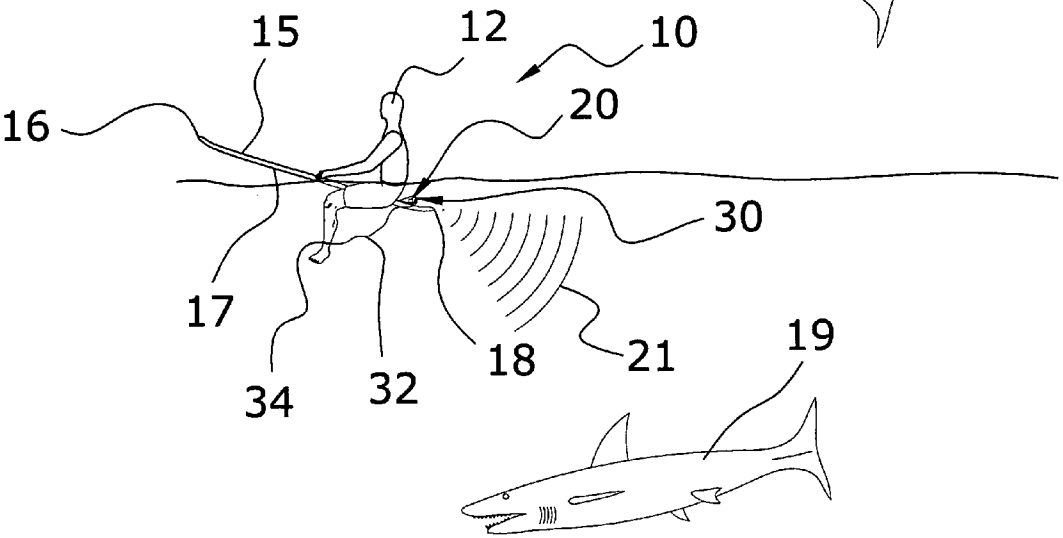
FIG. 8*b* is a side view of the present invention mounted and activated on a surfboard showing the transmission of sound waves and a deterred shark.

The transmitter unit 20 enclosure 23 is preferably comprised with an adhesive 28 backing on a mounting surface. The adhesive 28 will preferably withstand long exposure to salt water, humidity and sunlight such that the adhesive 28 will be resistant to delaminating. The adhesive 28 is used for attaching the transmitter unit 20 to the surfboard 14 rear end 18 as best illustrated in FIGS. 8*a* and 8*b* of the drawings. The rear end 18 placement for the transmitter unit 20 is preferred over a front end 16 placement because the rear end 18 of the surfboard 14 is located in the water more than the front end 16. It can be appreciated by one skilled in the art that other methods of attachment (e.g. fasteners) could be used to attach the transmitter unit 20 to a surfboard 14.

As shown in FIGS. 4, 5, 7 and 8*b*, the transmitter unit 20 emits sound waves 21 in a directional or omni directional manner. It is preferable that the transmitter unit 20 emits the sound waves 21 in an omni directional manner so as to ensure that sharks 19 near the user 12 are thoroughly deterred regardless of their location with respect to the user 12. The sound waves 21 are preferably at a frequency that is unpleasant to a shark 19. The transmitter unit 20 should emit sound waves 21 within the frequency band between 200 to 1500 hertz, but preferably in the frequency band between 700 to 900 hertz which has been found highly undesirable to sharks 19.

Figure 3:
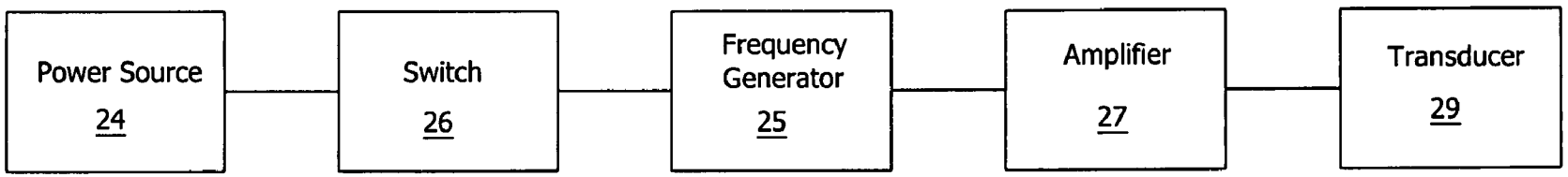
FIG. 3 is a block diagram of the electronic circuitry for the present invention.

The transmitter unit 20 preferably includes the enclosure 23, a power source 24, a power indicator 22, a frequency generator 25, a switch 26, an amplifier 27 and a transducer 29 as illustrated in FIG. 3 of the drawings. The power source 24 may be comprised of any type of portable source such as a battery. A switch 26, preferably utilizing the hall effect method activated by the placement of the magnet 30 may be electrically connected between the power source 24 and the frequency generator 25 as an on/off control. The power indicator 22 is preferably located on an outside surface of the enclosure 23 and indicates the remaining power level of the power source 24.

The frequency generator 25 is electrically connected to the power source 24 and may be comprised of any type of generator circuitry commonly utilized to generate a single frequency that is non-adjustable. The frequency signals generated by the frequency generator 25 are preferably comprised of a pulsed manner to reduce power consumption and thereby extend the life of the power source 24. However, the frequency signals generated by the frequency generator 25 may be in a random or constant manner. It can be appreciated that the frequency generator 25 may be comprised of a frequency generating system that creates varying frequencies.

As best shown in FIG. 3, the transducer 29 is electrically connected to the amplifier 27 for emitting the sound waves 21 within the water. The transducer 29 is preferably positioned within the enclosure 23 of the transmitter unit 20 in such a manner as to encourage omni directional sound wave 21 generation with limited obstruction by the body of the user 12. The transducer 29 may be comprised of any well-known structure utilized for generating sound waves 21 within water such as pinger devices.

C. Magnet and Attachment

Figure 2:
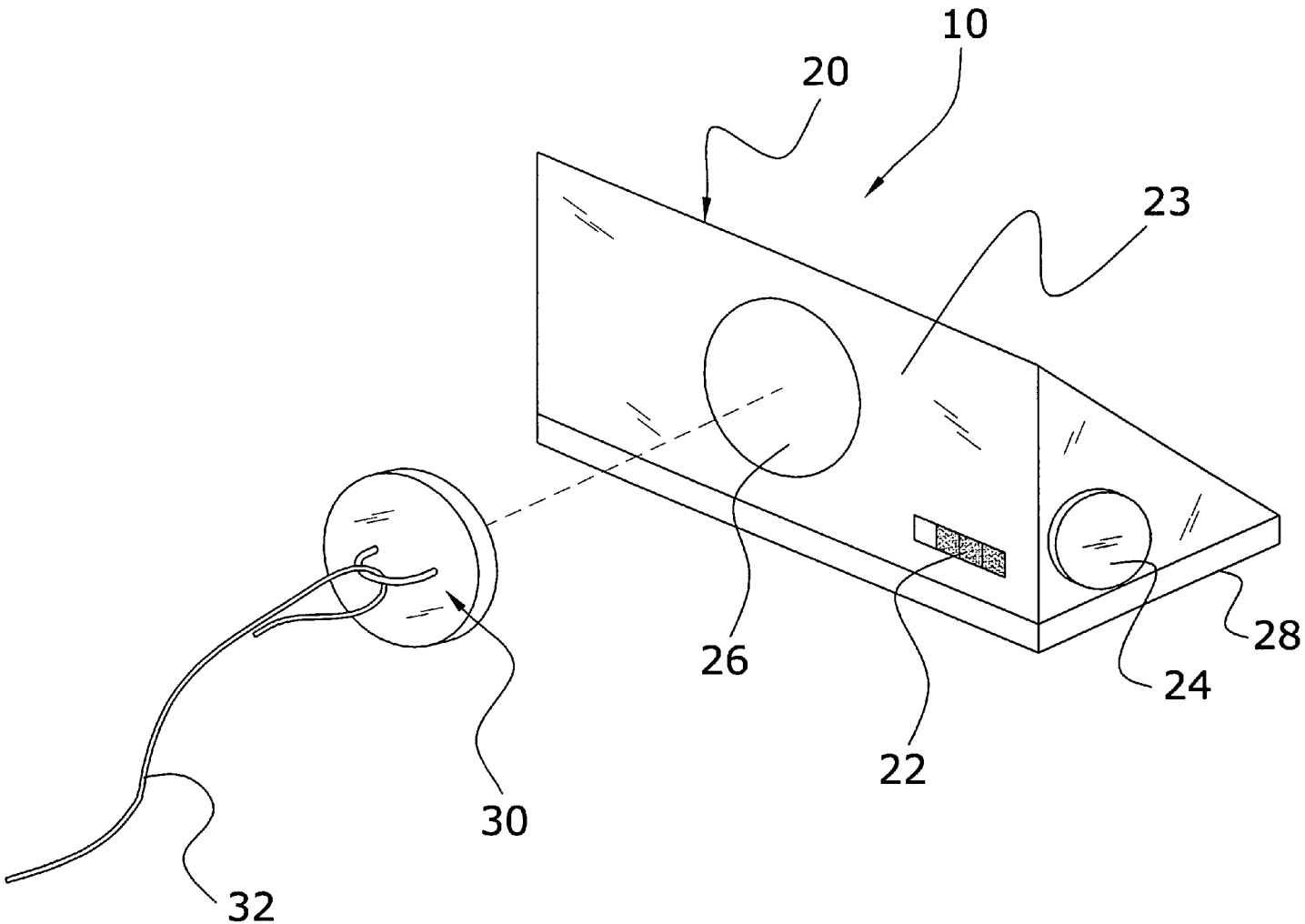
FIG. 2 is an exploded upper perspective view of the present invention.

The magnet 30 is preferably a round cylindrical structure as shown in FIGS. 1 and 2, but it can be appreciated that other shapes could be utilized. The magnet 30 may additionally be coated with a finishing material or process (e.g. powder coating) which must withstand long exposure to salt water, humidity and sunlight. The magnet 30 magnetic force is preferably strong enough to remain attached to the transmitter unit 20 while surfing, but also must be detachable by hand when not required.

The magnet 30, when attached to the switch 26 located on the transmitter unit 20, activates the frequency generator 25 to create the desired sound waves 21 as shown in FIGS. 1, 4, 5, 7 and 8*b*. When the magnet 30 is detached from the switch 26 located on the transmitter unit 20 (e.g. surfboard 14 is being transported on a vehicle) the frequency generator

Figure 6:
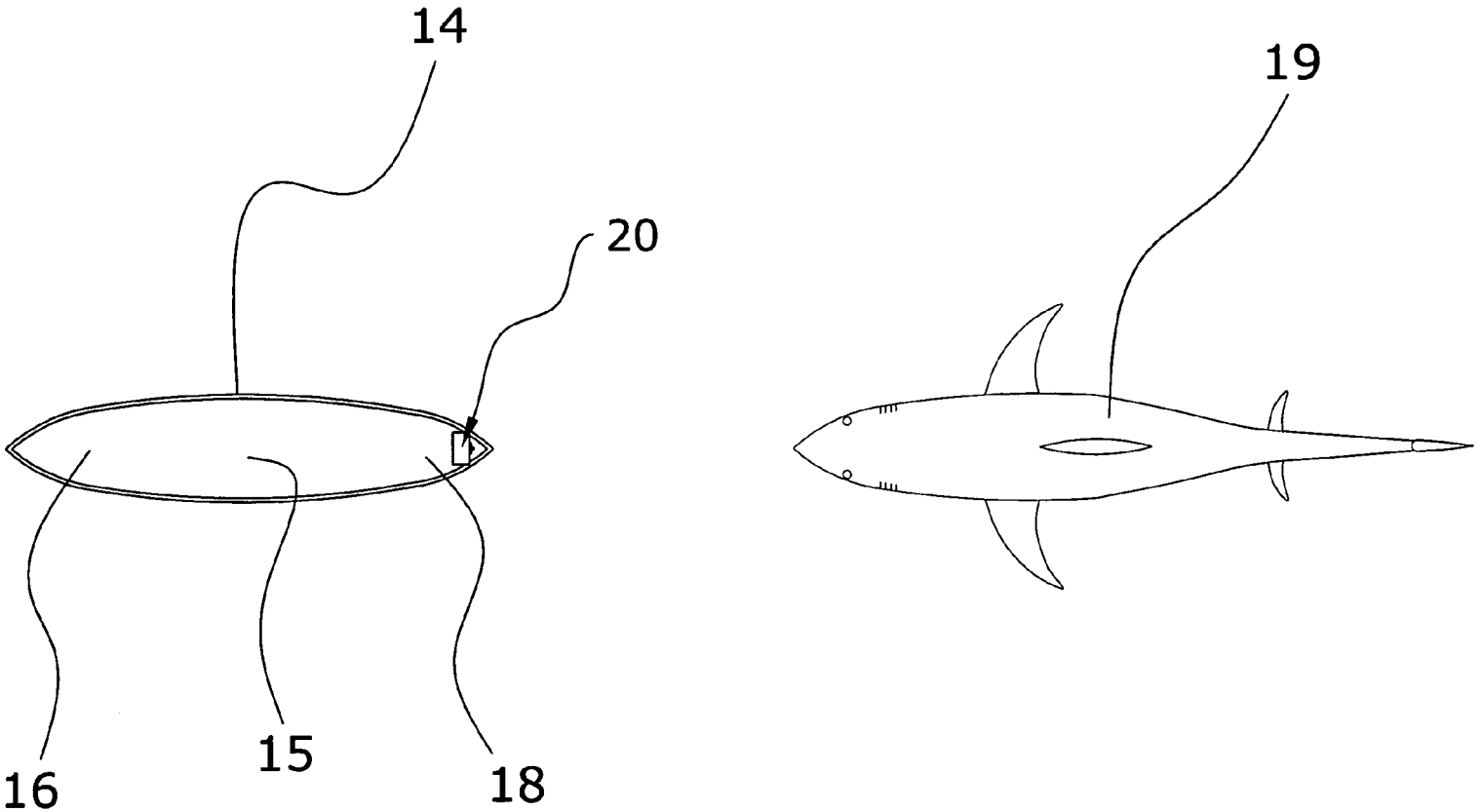
FIG. 6 is a top view of the present invention mounted on a surfboard and an approaching shark.
Figure 7:
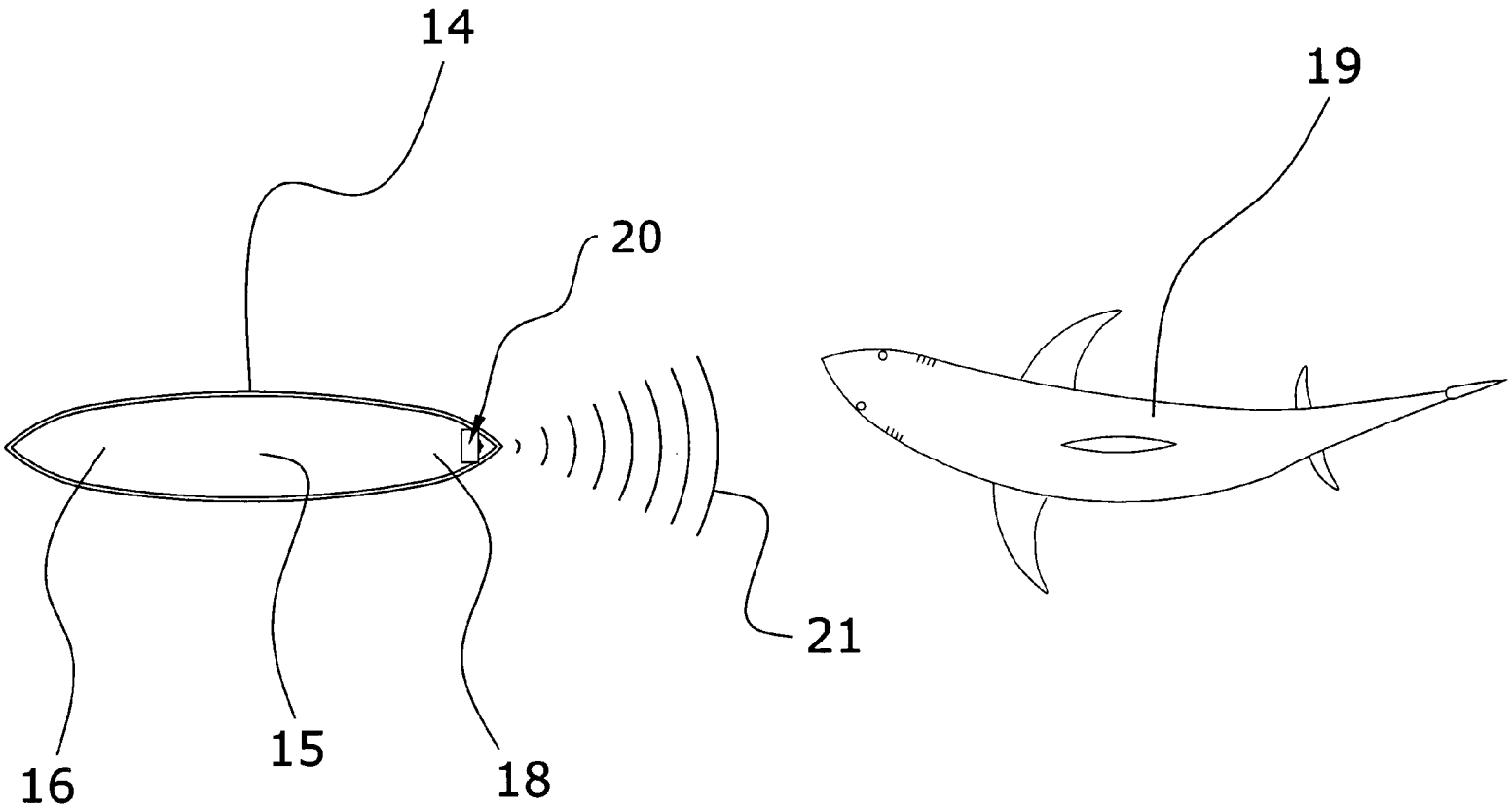
FIG. 7 is a top view of the present invention mounted and activated on a surfboard showing the transmission of sound waves and a deterred shark.

25 stops emitting sound waves 21 and conserves the power source 24 as best shown in FIGS. 2, 6 and 8*a*.

As best shown in FIGS. 1, 2, and 4 through 8*b*, the magnet 30 is preferably attached to a tether 32 and band 34 for strapping to the leg of a user 12. The tether 32 and band 34 are preferably constructed of an elastic or nylon material to allow for the required movements of the user 12 while surfing and also to obtain a secure fit when strapped to the user 12.

D. Operation of the Invention

In use, the surfboard shark repellent system 10 is preferably attached a surfboard 14, but it can be appreciated that the surfboard shark repellent system 10 could also be attached to other water floatation devices. The magnet 30 attached to a tether, strapped to the user 12, is connected to the switch 26 of the transmitter unit 20 activating the frequency generator 25 within the transmitter unit 20.

Initially the transmitter unit 20 of the surfboard shark repellent system 10 is adhered to the upper surface 15 towards the rear end 18 of a surfboard 14 using the adhesive 28 on the transmitter unit 20 as shown in FIGS. 6 through 8*b*. It is located at the rear end 18 of the surfboard 14 because as a user 12 waits for a wave, the rear end 18 of the surfboard 14 usually is submerged in the water as shown in FIGS. 8*a* and 8*b*. It can be appreciated that if used on other floatation devices, the surfboard shark repellent system 10 could be placed on a lower surface 17 to deter any sharks 19 in the area.

Figure 4:
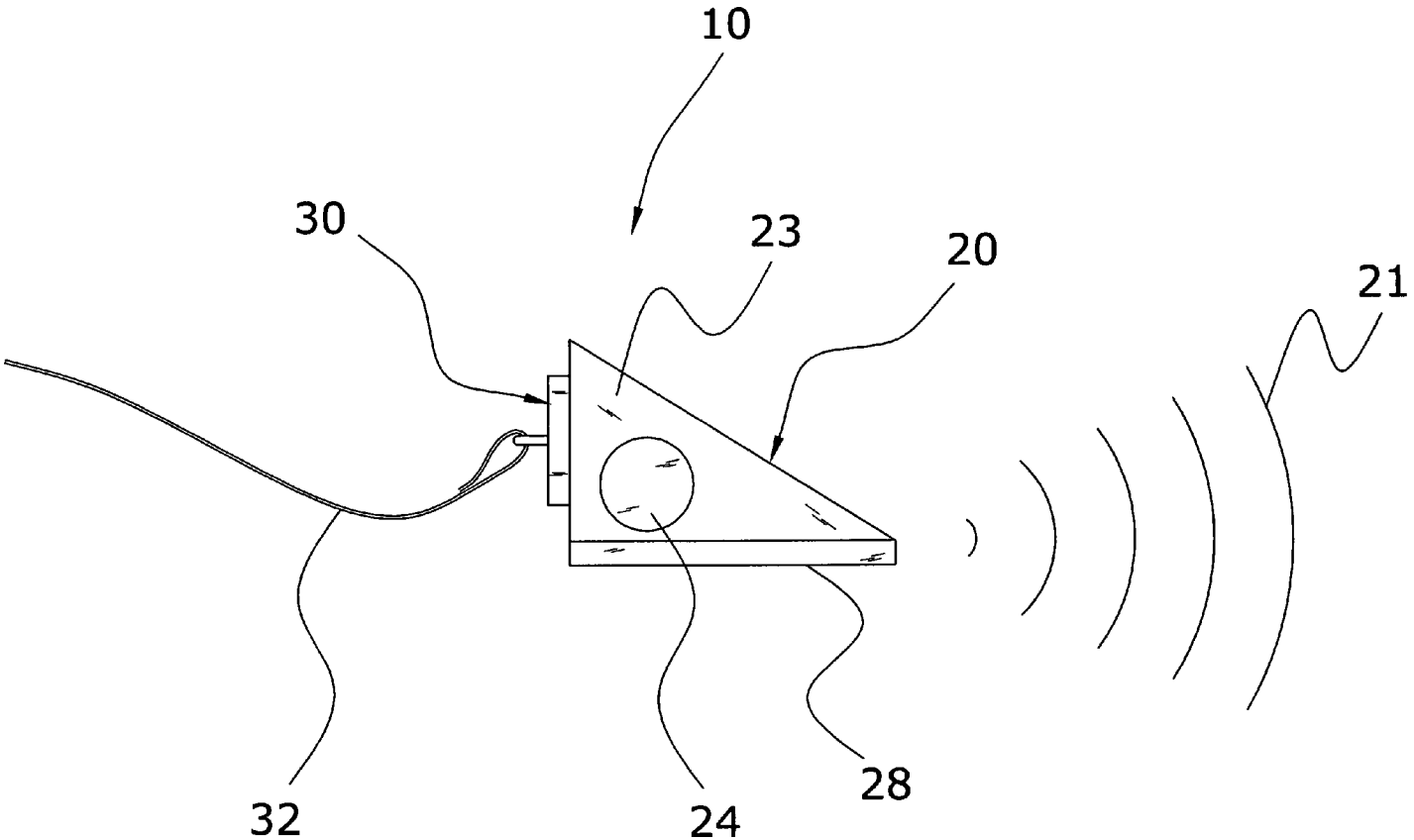
FIG. 4 is a side view of the present invention showing the transmission of sound waves.
Figure 5:
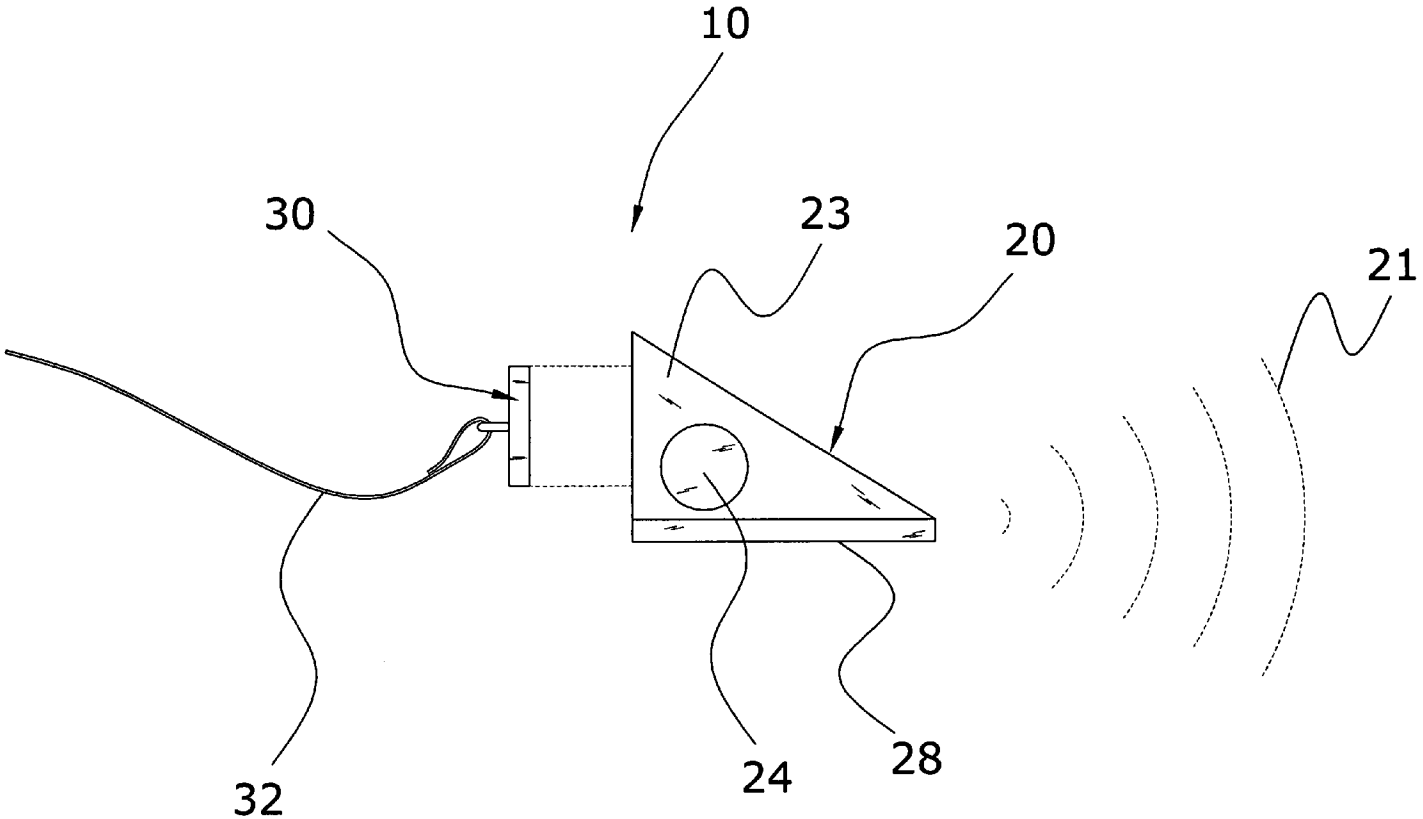
FIG. 5 is an exploded side view of the present invention showing the transmission of sound waves.

In use, as shown in FIGS. 8*a* and 8*b*, the user 12 straps the band 34 at one end of the tether 32 to their leg and attaches the magnet 30 at the other end of the tether 32 to the transmitter unit 20 switch 26. With the magnet 30 attached to the transmitter unit 20 switch 26, the frequency generator 25 begins emitting sound waves 21 and the user 12 can more safely wait in the water. Once surfing, the user 12 can either keep the magnet 30 attached to the transmitter unit 20 switch 26 as shown in FIGS. 1 and 4 or detach the magnet from the transmitter unit 20 switch 26 to conserve the power source 24 as shown in FIGS. 2 and 5.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A surfboard shark repellent system, comprising:
an enclosure attached to an upper surface of a surfboard;
a transmitter unit positioned within said enclosure, wherein said transmitter unit is capable of transmitting sound waves within a volume of water in a pulsing manner at a frequency undesirable to sharks; and
wherein said transmitter unit is comprised of:
a power source;
a switch electrically connected to said power source;
a frequency generator electrically connected to said switch;
an amplifier electrically connected to said frequency generator;
a transducer electrically connected to said amplifier for generating said sound waves; and
a magnet removably attachable to said switch for controlling activation of said switch.

2. The surfboard shark repellent system of claim 1, wherein said enclosure is positioned near a rear end of said surfboard.

3. The surfboard shark repellent system of claim 1, wherein said magnet is attached to a tether.

4. The surfboard shark repellent system of claim 1, wherein said enclosure is impermeable to water.

5. The surfboard shark repellent system of claim 1, wherein said enclosure has a triangular cross sectional area.

6. The surfboard shark repellent system of claim 1, wherein said enclosure includes an adhesive for securing said enclosure to said surfboard.

7. The surfboard shark repellent system of claim 1, wherein said frequency is between 700 Hz to 900 Hz.

8. The surfboard shark repellent system of claim 1, wherein said frequency is between 200 Hz to 1,500 Hz.

9. A surfboard shark repellent system, comprising:
a transmitter unit attached to a surfboard, wherein said transmitter unit is capable of transmitting sound waves within a volume of water in a pulsing manner at a frequency undesirable to sharks;
wherein said transmitter unit is comprised of:
a switch;
a sound wave generator electrically connected to said switch; and
a magnet removably attachable to said switch for controlling activation of said sound wave generator.

10. The surfboard shark repellent system of claim 9, wherein said magnet is attached to a tether.

11. The surfboard shark repellent system of claim 9, wherein said frequency is between 700 Hz to 900 Hz.

12. The surfboard shark repellent system of claim 9, wherein said frequency is between 200 Hz to 1,500 Hz.

13. A surfboard shark repellent system, comprising:
an enclosure attached to a surfboard;
a transmitter unit positioned within said enclosure, wherein said transmitter unit is capable of transmitting sound waves within a volume of water in a pulsing manner at a frequency undesirable to sharks; and
wherein said transmitter unit is comprised of:
a switch;
a frequency generator electrically connected to said switch;
an amplifier electrically connected to said frequency generator;
a transducer electrically connected to said amplifier for generating said sound waves; and
a magnet removably attachable to said switch for controlling activation of said switch.

14. The surfboard shark repellent system of claim 13, wherein said magnet is attached to a tether.

15. The surfboard shark repellent system of claim 13, wherein said frequency is between 700 Hz to 900 Hz.

16. The surfboard shark repellent system of claim 13, wherein said frequency is between 200 Hz to 1,500 Hz.

* * * * *